US006874768B2

(12) United States Patent
Grant

(10) Patent No.: US 6,874,768 B2
(45) Date of Patent: Apr. 5, 2005

(54) TRANSFER TUBE FOR CARBURETOR FUEL BOWLS

(76) Inventor: Barry S. Grant, Rte. 1, Box 1900, Dahlonega, GA (US) 30533

( * ) Notice: Subject to any disclaimer, the term of this patent is extended or adjusted under 35 U.S.C. 154(b) by 0 days.

(21) Appl. No.: 10/774,102

(22) Filed: Feb. 6, 2004

(65) Prior Publication Data

US 2004/0155367 A1 Aug. 12, 2004

Related U.S. Application Data

(60) Provisional application No. 60/445,776, filed on Feb. 6, 2003.

(51) Int. Cl.[7] ..... F02M 5/12
(52) U.S. Cl. ..... 261/70; 261/72.1; 261/DIG. 50
(58) Field of Search ..... 261/70, 72.1, DIG. 50, 261/DIG. 67

(56) References Cited

U.S. PATENT DOCUMENTS 4,100,232 A * 7/1978 Kaye ..... 261/36.2
4,270,504 A * 6/1981 Sciotti et al. ..... 123/520
5,057,249 A * 10/1991 Baltz et al. ..... 261/72.1
5,283,011 A * 2/1994 McClintic et al. ..... 261/23.2
5,368,788 A * 11/1994 Boyesen ..... 261/44.3
5,667,730 A * 9/1997 Barfield ..... 261/18.3
6,244,572 B1 * 6/2001 Delsole ..... 261/38
6,286,817 B1 * 9/2001 Grant ..... 261/70
6,364,291 B1 * 4/2002 Grant ..... 261/70
6,554,258 B2 * 4/2003 Braswell ..... 261/70
6,672,571 B2 * 1/2004 Gangler et al. ..... 261/70
6,726,185 B1 * 4/2004 Del Sole ..... 261/70
6,729,608 B1 * 5/2004 Del Sole ..... 261/38

FOREIGN PATENT DOCUMENTS

JP 58-180754 * 10/1983 ..... 261/DIG. 50

* cited by examiner

*Primary Examiner*—Richard L. Chiesa
(74) *Attorney, Agent, or Firm*—Thomas, Kayden, Horstemeyer & Risley, LLP

(57) ABSTRACT

Fuel bowls are placed on opposite sides of a carburetor, and a fuel transfer tube extends between the fuel bowls. External fuel receiving fixtures are mounted in fluid communication with the fuel bowls and have nipples facing each other. The fuel transfer tube is telescopically mounted at its ends to the nipples and O-rings seal the ends of the tubes to the nipples.

8 Claims, 2 Drawing Sheets

TRANSFER TUBE FOR CARBURETOR FUEL BOWLS

CROSS REFERENCE

Applicant claims the benefit of Provisional application No. 60/445,776 filed Feb. 6, 2003.

FIELD OF THE INVENTION

This invention concerns the supply of fuel to a carburetor of an internal combustion engine. More particularly, the invention concerns the supply of fuel to the fuel bowls that straddle a carburetor, and the improved fuel transfer tube assembly that extends between the fuel bowls.

BACKGROUND OF THE INVENTION

Many high performance internal combustion engines used for racecars employ carburetors for delivering fuel to the engines. Because a race car experiences extreme surges front to rear and side to side during its performance on the track, the fuel in the fuel bowl that supplies the fuel to the carburetor also tends to surge, so that the fuel in the fuel bowl sometimes tends to surge in the fuel bowl away from the carburetor. If the outlet port of the fuel bowl is adjacent the carburetor, there is a hazard of temporary starvation of fuel from the carburetor when the fuel surges away from the carburetor.

One solution for the problem is to provide two fuel bowls that straddle the carburetor, one fuel bowl on each side of the carburetor.

Another solution is to provide two fuel bowls that straddle the carburetor, one fuel bowl in front of the carburetor and the other fuel bowl behind the carburetor. This second design provides more fuel capacity and is less susceptible to the tendency of the fuel surging in the bowl. In order to assure proper delivery of fuel to the carburetor, especially during acceleration of the vehicle, a fuel supply outlet is positioned at the rear of the rear fuel bowl so as to assure that the fuel in the rear fuel bowl reaches the supply outlet upon acceleration of the vehicle. This assures that fuel will always surge toward a fuel port leading to the carburetor during extreme acceleration of the car.

In order to be able to provide fuel to the fuel bowls, a single fuel line leads from the fuel pump to one of the fuel bowls and a bypass line or "fuel transfer tube" extends from adjacent the one fuel bowl to the other fuel bowl. This supplies fuel from one fuel line and avoids having to use two fuel lines extending from the fuel pump to the two fuel bowls.

One of the prior art fuel transfer tube assemblies that communicates between the fuel bowls uses a specially designed sleeve-shaped seal at each of its ends to seal between the external end surfaces of the transfer tube and the opening of a fixture that communicates with the fuel bowl. The sealing sleeve provides only one sealing surface and is subject to damage when the transfer tube is being installed and when the fuel bowls are disassembled for adjustment and repair of the carburetor. The damaged sealing sleeve tends to leak fuel, and the location of the leak is at the top of the engine. The sleeve shaped seal, being of special design, typically is available only from the carburetor manufacturer, not likely from the typical hardware store.

Another prior art fuel transfer tube that extends between fuel bowls is a fuel transfer conduit that is cast as a part of the carburetor or as part of a kit or modular attachment to the carburetor. While the modular attachments simplify assembly, repair and adjustment of carburetors, they have not proven to be leak-proof, sometimes allowing fuel to leak from the carburetor assembly in the vicinity of the hot engine. It is difficult to repair the leak of this type of transfer tube.

All of the above-noted prior art fuel transfer tube assemblies include the hazard of fuel leakage about the carburetor and the hot engine below. If there is fuel leakage, these prior art devices are difficult to repair, as by acquiring the proper sealing sleeve that is a special order product, or by repairing the fuel transfer kit.

This invention addresses these problems.

SUMMARY OF THE INVENTION

Briefly described, the present invention comprises a transfer tube assembly for a carburetor having two fuel bowls mounted on opposite sides of the carburetor, whereby a single fuel line extending from the fuel pump provides fuel to the first fuel bowl, and a fuel transfer assembly divides the stream of fuel so as to supply fuel to the second fuel bowl.

Each fuel bowl includes a fuel inlet port, an external fuel receiving fixture in communicating with the fuel inlet port of the fuel bowl for delivering fuel from the fuel supply line to the fuel bowl, and a float valve inside the fuel bowl for controlling the admission of fuel through the fuel inlet port into the fuel bowl.

The external fuel receiving fixtures for each fuel bowl includes a nipple positioned upstream of the fuel receiving port with the nipple of each fixture facing the other nipple and with the nipples in alignment with each other. The fuel transfer tube extends between the facing nipples and is connected at its opposite ends to said nipples by telescopically extending the ends of the fuel transfer to about the nipples. O-ring grooves are interposed between the nipples and the ends of the fuel transfer tubes, and O-rings are seated in the O-ring grooves for sealing the fuel transfer tube at its ends to the nipples.

In the preferred embodiment at least two O-ring grooves are formed on each nipple and O-rings are seated in both O-ring grooves of each nipple, interposed between the nipples and each end of the fuel transfer tube. By using a pair of O-rings at each end of the fuel transfer tube, the sealing effect between the ends of the fuel transfer tube and their respective nipples is doubled. Also, O-rings are used in a standard size and shape that are available from the typical auto supply store or hardware store so that if a leakage should occur at one end of a fuel transfer tube, the leaking O-rings can be removed from their nipple, and new O-rings mounted on the nipple.

The fuel transfer tube is of a length so that its ends will extend about the nipples and about the O-ring seals of the external fuel sealing fixtures, so that no adjustment in the length of the fuel transfer tube or in the space between the external fuel sealing fixtures is required, and the likelihood of improper installation of the fuel transfer tube is reduced.

DETAILED DESCRIPTION

Figure 1:
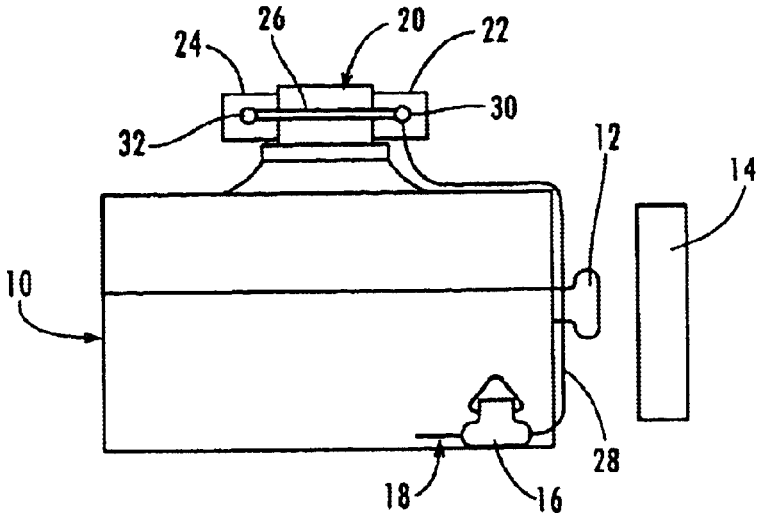
FIG. 1 is a side elevation view of a high performance engine of a vehicle, showing the carburetor, fore and aft fuel bowls and the fuel transfer tube.

Referring now in more detail to the drawings in which like numerals indicate like parts throughout the several views, FIG. 1 illustrates an internal combustion engine 10 of a high performance vehicle, that includes the usual components such as water pump 12, radiator 14, fuel pump 16 and fuel line 18 extending from the fuel tank (not shown) that is usually mounted at the rear of the vehicle. The carburetor 20 is mounted on the upper surface of the engine 10, with front fuel bowl 22 and rear fuel bowl 24 mounted to the carburetor and with the fuel transfer tube 26 extending between the fuel bowls 22 and 24. The fuel line 28 extends from the fuel pump 16 to one of the fuel bowls, such as fuel bowl 22.

Figure 2:
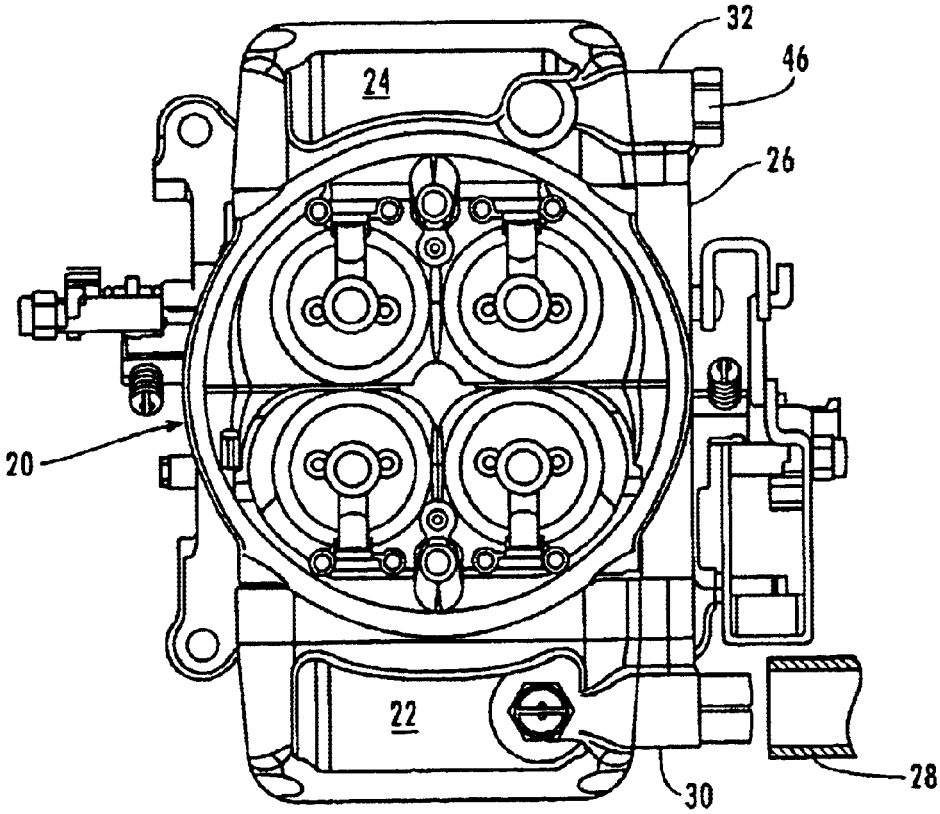
FIG. 2 is a top view of a four-barrel carburetor with fuel bowls positioned on the front and rear sides of the carburetor, and the fuel transfer tube assembly extending between the fuel bowls.
Figure 5:
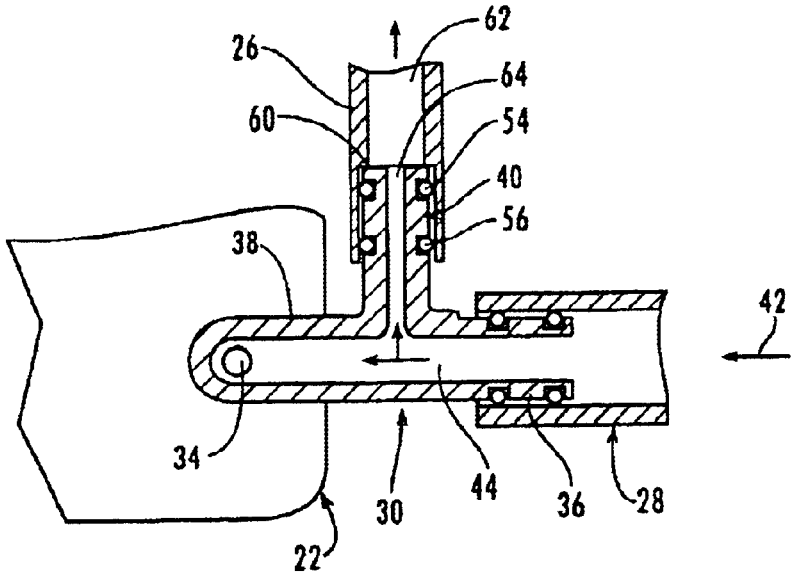
FIG. 5 is a schematic illustration of the external fuel receiving fixture, showing how it connects between the fuel line, fuel transfer tube and fuel bowl.

As shown in FIGS. 2 and 5, a fuel receiving fixture 30 or 32 is mounted to each fuel bowl 22, 24, respectively, and the fuel receiving fixture 30 communicates with the delivery end of the fuel line 28 that extends from the fuel pump 16 about the engine 10. A fuel inlet port of each fuel bowl (FIG. 5), such as port 34 of fixture 30, communicates between the fixture 30 and its fuel bowl 22 and a float valve (not shown) positioned inside the fuel bowl regulates the flow of fuel through the fuel port 34 into the fuel bowl 22. Fuel bowl float valves are conventional in the art, and the valve is controlled by a float that rides on the fuel within the fuel bowl with the float opening the valve when the level of fuel is low in the fuel bowl. This is known in the art.

The external fuel receiving fixtures 30 and 32 are mirror images of each other and each includes an inlet conduit 36, a delivery conduit 38, and a bypass conduit that is in the form of a nipple 40. The delivery conduit 38 of each fixture 30, 32 is mounted to the fuel bowls 22, 24, and is in fluid communication with the fuel inlet port 34 and its float valve. The fuel flow as indicated by arrow 42 enters from the fuel line 28 into the fuel inlet conduit 36. The fuel is divided at the intersection of the delivery conduit 38 and bypass conduit or nipple 40 as indicated by the double arrow 44.

The opposite external fuel-receiving fixture 32 has a plug 46 blocking its inlet conduit 36.

The external fuel receiving fixtures 30 and 32 are identical and are both mounted with their bypass conduits or nipples 40 facing each other and in alignment with each other, and rectilinear fuel transfer tube 26 is mounted to and telescopically about the nipples of the fixtures. The length of the fuel transfer tube is sufficient so as to be fully received about the nipples 40 when the components such as the fuel bowls 22 and 24 and their fixtures are properly installed about the carburetor 20.

Figure 3:
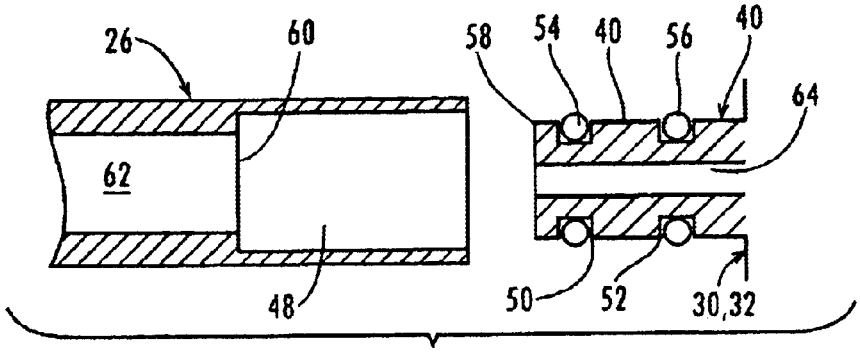
FIG. 3 is an expanded detailed view of the end of a nipple and the mating end of a fuel transfer tube.
Figure 4:
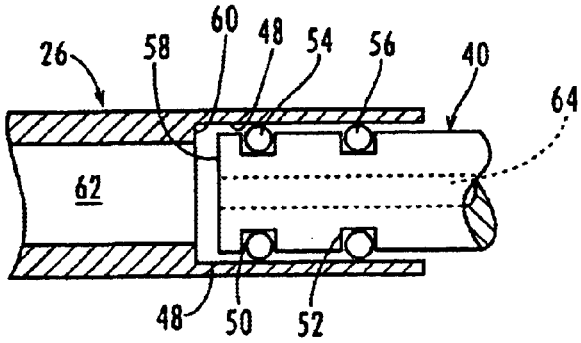
FIG. 4 is a detailed view, similar to FIG. 3, but showing the fuel transfer tube mounted to the nipple.

As shown in FIGS. 3 and 4, both ends of the fuel transfer tube 26 are preferably undercut by a counter bore 48 which is sized in diameter and is of a length sufficient to receive the nipples 40 that extend from the external fuel receiving fixture 30, 32. O-ring grooves 50 and 52 are formed along the length of the nipple 40, and O-rings 54 and 56 are placed in the annular O-ring grooves, as illustrated in FIGS. 3 and 4. The counter bores 48 are of lengths to receive and seal against the O-rings 54 and 56.

When the ends of the fuel transfer tube 26 are mounted on the nipples 40, the ends 58 of the nipples tend to bottom out against the heel 60 formed at the end of the counter bore 48 and the central passage 62 of the fuel transfer tube 26. This assures that both of the O-rings 54 and 56 are properly received inside the counter bore 48 at the ends of the fuel transfer tube 26. Thus, the central passage 62 of the fuel transfer tube 26 becomes aligned with the central passage 64 of the nipple 40. The inside diameter of the fuel transfer tube is greater than the inside diameter of the nipples, avoiding constriction between the nipples.

With this construction, the fuel receiving fixtures 30 and 32 form mounting means for the fuel bowls, extending into the counterbores at the ends of the fuel transfer tube.

Although a preferred embodiment of the invention has been disclosed in detail herein, it will be obvious to those skilled in the art that variations and modifications of the disclosed embodiment can be made without departing from the spirit and scope of the invention as set forth in the following claims.

I claim:

1. In a carburetor assembly of a combustion engine of a vehicle having fuel bowls positioned on opposed sides of the carburetor, each of said fuel bowls having a fuel inlet port, an external fuel receiving fixture mounted to each fuel inlet port, a fuel transfer assembly extending between the fuel receiving fixtures, a fuel supply line in fluid communication with one of the fixtures, and a float valve in each fuel bowl for controlling the admission of fuel through said fuel inlet ports into each of the said fuel bowls, the improvement therein of:

said external fuel receiving fixtures each including a nipple, said nipples facing and in alignment with each other, a fuel transfer tube extending between said nipples, the fuel transfer tube having opposed ends and connected at its opposed ends to said nipples, and O-ring grooves interposed between said nipples and the ends of said fuel transfer tubes, and O-rings seated in said O-ring grooves for sealing said fuel transfer tube at its ends to said nipples.

2. The carburetor of claim 1, wherein said O-ring grooves comprise at least two O-ring grooves formed on each nipple, and said O-rings comprise an O-ring seated in each O-ring groove.

3. The carburetor of claim 2, wherein said fuel transfer tube defines a counterbore at each end, and the nipples are received in the counterbores.

4. The carburetor of claim 3, wherein said nipples are spaced apart a distance less than the length of said fuel transfer tube, such that the ends of the fuel transfer tube are supported in place by the nipples without requiring additional fasteners.

5. In a carburetor assembly of a combustion engine of a vehicle having fuel bowls positioned on opposed sides of the carburetor, a fuel transfer assembly extending between the fuel bowls, and a fuel supply line in fluid communication with the fuel transfer assembly, the improvement therein of:

said fuel transfer assembly comprising a fuel transfer tube having an internal passage and oppositely facing ends, the opposite ends of the transfer tube each defining a counterbore of greater breadth than the internal passage, said fuel bowls each including mounting means extending into a counterbore of said fuel transfer tube in fluid communication therewith and supporting the fuel transfer tube without additional support being required, and O-rings positioned between the counterbores of the fuel transfer tube and the mounting means for sealing the ends of the fuel transfer tube to the mounting means.

6. In the carburetor of claim 5, each mounting means comprising a fuel receiving fixture in fluid communication with each fuel bowl and including nipples facing and in alignment with the opposite fuel receiving fixtures and spaced apart a distance less than the length of the fuel transfer tube and trapping the ends of the fuel transfer tube.

7. In the carburetor of claim 6, wherein

O-ring grooves are formed on said nipples.

8. In the carburetor of claim 6, wherein said fuel transfer tube has a larger inside diameter than the inside diameter of the nipples.

* * * * *